United States Patent [19]

Foreman, Jr.

[11] 4,090,351

[45] May 23, 1978

[54] GRAVITY CLOCK

[75] Inventor: Jay M. Foreman, Jr., Los Angeles, Calif.

[73] Assignee: Citizen Watch Co., Ltd., Tokyo, Japan

[21] Appl. No.: 735,506

[22] Filed: Oct. 26, 1976

[51] Int. Cl.[2] ..... G04C 3/00; G04B 15/00

[52] U.S. Cl. ..... 58/23 D; 58/124; 58/23 R

[58] Field of Search ..... 58/2, 7, 107, 108, 123, 58/124, 126 A, 126 B, 144, 23 R, 23 D, 129

[56] References Cited

U.S. PATENT DOCUMENTS 304,072 8/1884 Buell ..... 58/2

*Primary Examiner*—Robert K. Schaefer
*Assistant Examiner*—Leonard W. Pojunas, Jr.
*Attorney, Agent, or Firm*—Koda and Androlia

[57] ABSTRACT

A timepiece which indicates the time by means of hands such as an hour hand, minute hand, etc. wherein at least one of the hands which is rotatably coupled to the timepiece is provided with a means for causing the center of gravity of the hand to rotate about the point at which the hand is rotatably coupled to the timepiece.

12 Claims, 4 Drawing Figures

GRAVITY CLOCK

BACKGROUND OF THE INVENTION

1. Field of Invention

This invention relates to timepieces and more particularly to timepieces rotatably driven by the torque generated by gravitational influences.

2. Prior Art

In conventional timepieces which indicate the time by means of revolving parts such as an hour hand, minute hand, etc., the revolving parts which indicate the time are mounted on an hour wheel, cannon pinion, etc. which form the parts of the timepiece movement. Accordingly, the degree of freedom in timepiece design is greatly limited by the mutual positional relationship between the timepiece movement and the revolving parts which indicate the time. As a result, the esthetic and artistic development of timepieces has been inhibited.

SUMMARY OF THE INVENTION

It is a general object of the present invention to provide a timepiece whose hands are not directly driven by a timepiece movement.

It is another object of the present invention to provide a timepiece whose freedom of design is greatly expanded.

It is yet another object of the present invention to provide a timepiece in which the hands are caused to rotate with a fixed period as a result of gravitational influences.

It is still another object of the present invention to provide a timepiece wherein the means for causing the revolution of the hands is provided in the hands themselves.

In keeping with the principles of the present invention, the objects are accomplished with a unique gravity clock which indicates the time by means of hands. The gravity clock comprises at least one hand rotatably coupled to the gravity clock and a means provided on the hand for causing the center of gravity of the hand to rotate about the point at which the hand is rotatably coupled to the clock.

In the preferred embodiment the means for causing the center of gravity of the hand to rotate comprises a weight and a means for causing the weight to rotate with a fixed period fixed to the hand.

BRIEF DESCRIPTION OF THE DRAWINGS

The above mentioned and other features and objects of the present invention will become more apparent by reference to the following description taken in conjunction with the accompanying drawings, wherein like referenced numerals denote like elements, and in which.

DETAILED DESCRIPTION OF THE INVENTION

Figure 1:
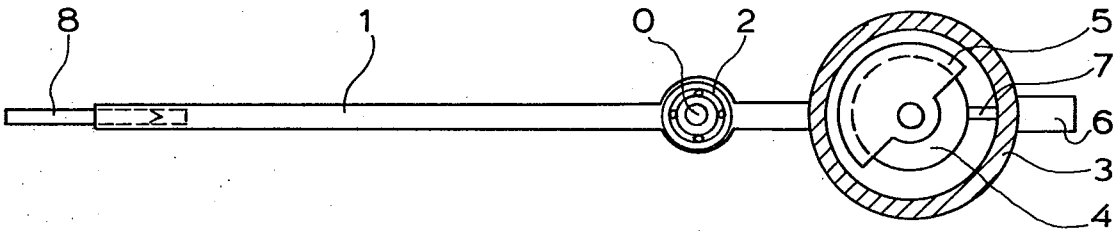
FIG. 1 is a partial sectional plan view of a revolving part of a gravity clock in accordance with the teachings of the present invention.

Referring more particularly to the drawings, FIG. 1 is a partial section plan view of a revolving part such as an hour hand or minute hand of a gravity clock in accordance with the teachings of the present invention. The body of the indicator hand 1 is rotatably coupled by an antifriction bearing 2 having a center of revolution at 0. Furthermore, a movement case 3 is provided adjacent one end of the body of the indicator hand 1 and an adjustment part 8 for adjusting the position of the center of gravity relative to the length of the moving part is provided adjacent the other end of the body of the indicator hand 1.

The movement case 3 contains a timepiece movement 4 which is similar to conventional timepiece movements. A weight 5 is provided on the cannon pinion or hour wheel, etc. (not shown) which are parts of the aforementioned timepiece movement 4 and which revolve with fixed periods. For this case, when the revolving member happens to be an hour hand, the aforementioned weight 5 is mounted on the hour wheel and completes one revolution every 12 hours. When the revolving member is a minute hand, the weight is mounted on the cannon pinion which completes one revolution every hour. The position of the center of revolution of the weight 5 and the center of the timepiece movement 4 are established such that they are on the central longitudinal axis of the body of the indicator hand 1. Furthermore, the external manipulating part 6 which engages with the time correction mechanism (not shown) of the timepiece movement 4 is installed so that it projects from the movement case such that it coincides with the central longitudinal axis of the body of the indicator hand 1. The time correction mechanism and the external manipulating part 6 are similar in construction to the hand correction mechanisms and external manipulating parts used in conventional timepieces. In particular, the correction of the indicated time is accomplished by pulling out the external manipulating part 6 (stem crown, etc.) which is attached to winding stem 7 to a given position and then rotating it. However, the gravity clock in accordance with the teachings of the present invention differs from conventional timepieces in that the correction of the time is not indicated by means of direct mechanical transmission of the rotation of the external manipulating part 6 to the revolving parts which indicate the time. However, since the movement and function of this mechanism will be described by the concrete terms below, their description is omitted here.

In practice, the weight 5 can be made from a material with a relatively high specific gravity and has a center of gravity which is very eccentric relative to the center of revolution. Furthermore, the weight 5 is made in the same manner as the self-winding weights used in conventional self-winding timepieces.

Figure 2:
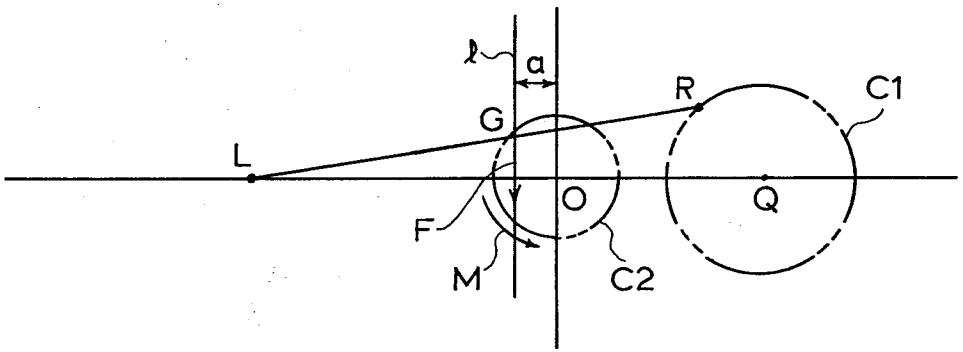
FIG. 2 is an illustration of the principle of motion of the gravity clock of FIG. 1.

Referring to FIG. 2, shown therein is a graphical representation of the principle of motion of the revolving member of FIG. 1. In FIG. 2, point L indicates the position of the center of gravity of the left half of the revolving member shown in FIG. 1 relative to the center of revolution 0. Similarly, point R indicates the position of the center of gravity of the right half of the revolving member shown in FIG. 1. In this case, the weight 5 is fastened to the hour wheel or cannon pinion which are parts of movement 4 and revolves with a fixed period. Accordingly, the position of the center of gravity R of the entire right half of the revolving member (including the weight 5) revolves with the same period as the hour wheel or cannon pinion along a circle C1 whose center is at a point Q. Furthermore, if LW is the weight of the left half of the revolving part, RW is the weight of the right half of the revolving member, G is the point indicating the center of gravity of the revolving member as a whole, and $\overline{LG}$ and $\overline{GR}$ are the respective distances connecting the points G with points L and R, then the location of the point G is one point on the line LR which satisfies the condition $\overline{LG} \times LW = \overline{GR} \times RW$. Accordingly, point G is also on a line LR and revolves with the same period as the hour wheel or the cannon pinion around the center of revolution located on the central logitudinal axis of the body of indicator hand 1, and at a point which bisects the line segment $\overline{LQ}$ where $LW = LW$.

It is clear from the above that it is possible, by means of appropriate establishments of the positions of the points L and R and of the weights RW and LW to construct a revolving member such that the center of gravity of the revolving member as a whole revolves about a circle C2 whose center of revolution is 0. In this embodiment, an adjustment part 8 is provided for the purpose of adjusting the position of the center of gravity L of the left half of the revolving part. Thusly, by moving the aforementioned adjustment part 8 an appropriate distance in or out of the length of the body of the indicator hand 1, it is possible to make fine adjustments so that the center of gravity G of the revolving member as a whole revolves along a circle C2 whose center is very nearly the center of revolution 0. Accordingly, in the above configuration, a torque M is generated (except when the position of the center of gravity G of the revolving part as a whole is directly beneath the center of revolution 0) on the revolving member itself as a result of the positional relationship between the center of revolution 0 and the force F, due to gravity, operating upon the center of gravity G. Furthermore, if "*a*" is the distance between the center of revolution 0 and the line *l* along which the force F acts, the torque M is expressed as a product of the force F and a distance "*a*". Accordingly, when the center of gravity G is directly beneath the center of revolution 0, the aforementioned torque M becomes 0 and the revolving member achieves equilibrium.

Accordingly, even though the center of gravity G of the revolving member as a whole continues its fixed period revolution about the center of revolution 0, it is constantly being pulled back toward a point directly beneath the center of revolution 0. As a result, the revolving member as a whole revolves with a fixed period around the center of revolution 0.

It is clear that with a construction such as that described above that it is possible to indicate the time since the revolving member in this embodiment revolves with a fixed period in the same manner as an hour hand or a minute hand of the conventional timepiece.

Furthermore, if the indicated time is in need of correction, the external manipulating part 6 is pulled out to a given position and rotated, which, via the time correction mechanism (not shown) of the movement 4, causes the hour wheel or cannon pinion to rotate. Therefore, the weight 5 can be rotated to any chosen position. In this case, the time correction mechanism is similar in construction to the hand correction mechanism of conventional timepieces, but the difference from those correction mechanisms of conventional timepieces is that the weight 5 is attached directly to the hour wheel and cannon pinion rather than an hour hand or a minute hand. Therefore, rotation of the external manipulating part is transmitted to the weight 5 via the time correction mechanism, not shown. Therefore, the indicated time is corrected by rotating the external manipulating part 6 thereby rotating the position of the center of gravity G so that the revolving member involved is stabilized in a position which indicates the correct time.

Figure 4:
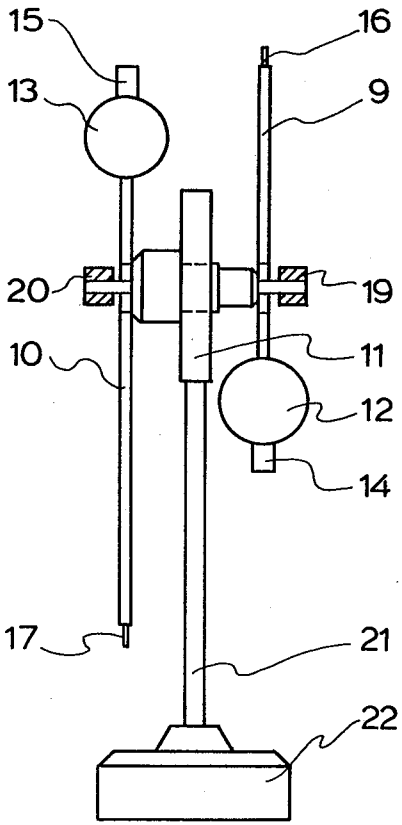
FIG. 4 is a side view of a gravity clock in accordance with the teachings of the present invention.
Figure 3:
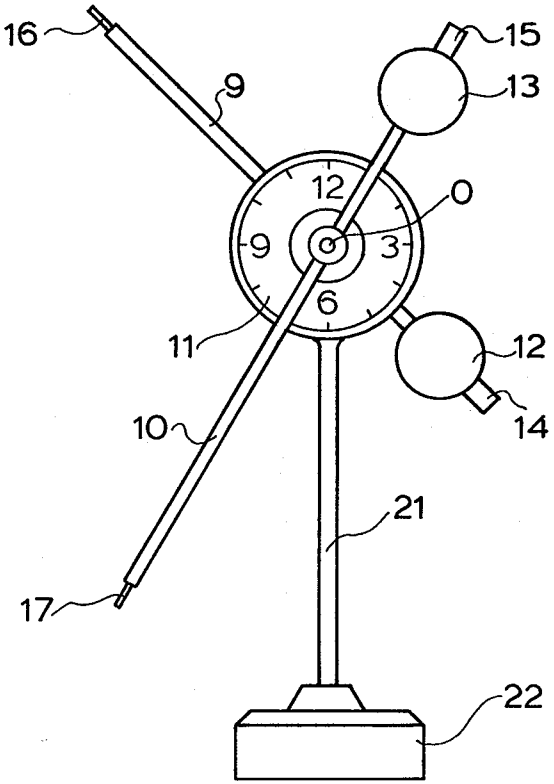
FIG. 3 is a front view of a gravity clock in accordance with the teachings of the present invention.

Referring to FIGS. 3 and 4, shown therein are the front and side views of a gravity clock in accordance with the teachings of the present invention. Hour and minute hands 9 and 10 are respectively installed on the exterior and interior sides of the dial 11 and are of the same construction as the revolving part of FIG. 1. As a result, the external appearance of the gravity clock as a whole is balanced and pleasing to the eye. Furthermore, movement cases 12 and 13 are installed separately on the hour hand 9 and minute hand 10. The movement cases 12 and 13 contain timepiece movements which are not shown. Furthermore, external manipulating parts 14 and 15 are provided on the movement cases 12 and 13 and adjustment parts 16 and 17 for adjusting the positions of the centers of gravity along the length of the hour and minute hands 9 and 10 are provided adjacent the ends of the hour and minute hands 9 and 10. The external manipulating parts 14 and 15 and the adjustment parts 16 and 17 are provided so that their central axes coincide with the central longitudinal axis of either the hour hand or the minute hand, as the case may be. With this type of construction, it is easy to establish the center of gravity of the hour hand 9 or minute hand 10 in the appropriate position and the external appearance of the clock is pleasing to the eye. A supporting pivot pin 18 is fixed to dial 11 and carries arbors 19 and 20 of the hour and minute hand 9 and 10. The dial 11 is fastened to a stand 22 by means of a dial support 21.

With the above described construction, the hour hand 9 and the minute hand 10 will revolve with respective periods of 12 hours and 1 hour around their arbors 19 and 20 and are thus able to indicate the time in the same manner as the hour and minute hands of conventional timepieces. Furthermore, since the movements are installed as parts of the hour and minute hands, it is not necessary to install a movement in any part of the clock outside of the minute and hour hands 9 and 10. Accordingly, the clock may be of an unconventional and novel design.

As described above, the fundamental principle of the invention is as follows:

Since it is equipped with a means for causing the positions of the center of gravity of the time indicating revolving members as a whole to revolve with appropriate periods. The revolving members themselves are driven by a torque which arises from the relationship between the direction of the gravitational force, the center of revolution of the revolving members and the centers of gravity of the revolving members. Accordingly, this invention can provide a timepiece in which the movements are installed nowhere but in the revolving members themselves. Furthermore, this invention greatly expands the degree of freedom in timepiece design that makes it possible to build a table clock with an extremely novel external appearance. In addition, especially if the movement cases installed on the hour and minute hands 9 and 10 are designed so that they are nontransparent and ornamental, the movements inside the movement cases can be concealed and, from the viewpoint of the persons examining the gravity clock, the principle of motion can be wrapped in a veil of mystery thus creating a very impressive affect when the clock is displayed.

Although in the above described embodiment of the gravity clock, only an hour hand and a minute hand were employed as time indicating revolving members, it should be apparent to one skilled in the art that other revolving indicators such as a second hand, calendar system, etc. could be similarly installed. In such a case, it is advisable that the movement installed in the second hand be a tuning fork-type timepiece movement with a high wheel train torque. Also, it should be apparent that by installing structural components of a mechanical-optical indicating system (lenticular lens, moire fringe system, etc.) in one or more of the revolving members which has a relatively high rate of revolution, a minute hand or second hand, it is possible to obtain a wide variety of indicating effects. Also, it is not essential that the device for causing the fixed period of revolution of the centers of gravity of the revolving members is mounted in the revolving members or that it is a clock movement in which a weight is attached to the hour wheel or clock pinion. It could also be a step motor with an eccentric center of gravity or some other device. In such a case, it would also be permissible to install the circuitry for running the step motor in some part of the clock other than the revolving members. Also, it should be apparent that the timepiece movement could not only be powered by a battery, but also could be a wound spring movement.

In all cases, it is understood that the above described embodiment is merely illustrative of but one of the many possible specific embodiments which can represent applications of the principles of the present invention. Numerous and varied other arrangements can be readily devised by those skilled in the art without departing from the spirit and scope of the invention.

I claim:

1. A timepiece comprising:

at least one rotatably supported revolving member for indicating the time;

a means fixed distantly from the point of rotatable support on said rotatably supported revolving member for causing the center of gravity of said revolving member to revolve whereby said revolving member is caused to revolve.

2. A timepiece according to claim 1 wherein said means for causing the center of gravity to revolve comprises:

a timepiece movement having a rotating output which rotates with a fixed period equal to the period of one revolution of said rotatably supported member; and a weight fixed to said output whose center of gravity is very eccentric relative to the axis of rotation of said output whereby gravity force of said weight causes the rotation of said rotatably supported member.

3. A timepiece according to claim 2 wherein said timepiece comprises at least two independently rotatably supported revolving members.

4. A timepiece according to claim 3 wherein said revolving members comprise an hour and a minute hand.

5. A timepiece comprising:

at least one rotatably supported revolving member for indicating the time;

a means provided on said rotatably supported revolving member for causing the center of gravity of said revolving member to revolve whereby said revolving member is caused to revolve; and a means for adjusting the position of said center of gravity of said revolving member.

6. A timepiece having a face comprising:

at least one revolving member rotatably coupled to said face at a bearing point for indicating the time; and a movement means provided in said revolving member for causing the center of gravity of said revolving member and said movement means to rotate about said bearing point whereby said revolving member is caused to revolve about said bearing point as a result of gravitational force acting on said center of gravity.

7. A timepiece according to claim 6 wherein said movement means comprises:

a timepiece movement having a rotating output which rotates with a fixed period; and a weight fixed to said output whose center of gravity is eccentric relative to the axis of rotation of said output.

8. A timepiece according to claim 7 wherein said timepiece comprises at least two rotatably supported revolving members.

9. A timepiece according to claim 8 wherein said revolving members comprise an hour and a minute hand.

10. A timepiece according to claim 7 further comprising a means for adjusting the position of said center of gravity of said revolving member and said movement means such that said center of gravity revolves about said bearing point in a substantially circular path.

11. A timepiece having a face comprising:

at least one revolving member rotatably coupled to said face at a bearing point for indicating the time;

a movement means provided said revolving member causing the center of gravity of said revolving member and said movement means to rotate about said bearing point whereby said revolving member is caused to revolve about said bearing point as a result of a gravitational force acting on said center of gravity, said movement means comprising:

a timepiece movement having a rotating output which rotates with the fixed period; and a weight fixed to said output whose center of gravity is eccentric relative to the access of rotation of said output; and a means for adjusting the position of said center of gravity of said revolving member and said movement means such that the center of gravity revolves about said bearing point and substantially circular path, said means for adjusting the position of said center of gravity comprising a weight whose position relative to said bearing point is adjustable.

12. A timepiece having a face comprising:

at least one revolving member rotatably coupled to said face at the bearing point for indicating the time;

a movement means provided in said revolving member for causing a center of gravity of said revolving member and said movement means to rotate about said bearing point whereby said revolving member is caused to revolve about said bearing point as a result of a gravitational force acting on said center of gravity, said movement means comprising:

a timepiece movement having a rotating output which rotates with the fixed periods; and a weight fixed to said output whose center of gravity is eccentric relative to the access of rotation of said output;

a means for adjusting the position of said center of gravity of said revolving member and said movement means such that such center of gravity revolves about said bearing point in a substantially circular path; and an external manipulating part which corrects the time indicated by said revolving member by causing said movement means to rotate said center of gravity about said bearing point in response to an input via said external manipulating part.

* * * * *